US006429727B1

(12) United States Patent
Gibson et al.

(10) Patent No.: US 6,429,727 B1
(45) Date of Patent: Aug. 6, 2002

(54) LOW EMI SHUTDOWN CIRCUIT FOR MODEM APPLICATIONS

(75) Inventors: Neil Gibson, Richardson; Marco Corsi, Allen; William A. Phillips, Dallas, all of TX (US)

(73) Assignee: Texas Instruments Incorporated, Dallas, TX (US)

( * ) Notice: Subject to any disclaimer, the term of this patent is extended or adjusted under 35 U.S.C. 154(b) by 45 days.

(21) Appl. No.: 09/678,887

(22) Filed: Oct. 3, 2000

(51) Int. Cl.[7] ..... G05F 1/10

(52) U.S. Cl. ..... 327/538; 327/539

(58) Field of Search ..... 327/530, 538–543, 327/407–411; 323/312–317

(56) References Cited

U.S. PATENT DOCUMENTS 5,319,303 A * 6/1994 Yamada ..... 327/538
6,011,548 A 1/2000 Thacker ..... 345/327

* cited by examiner

*Primary Examiner*—Kenneth B. Wells
(74) *Attorney, Agent, or Firm*—Dwight N. Holmbo; Wade James Brady III; Frederick J. Telecky Jr.

(57) ABSTRACT

A low EMI bias current generator for cable modem applications has a distributed output stage with a steering input that controls the amount of bias current flowing through each transistor of a differential pair. A pair of resistors acts as a potentiometer controlling the amount of voltage seen across the input of the differential pair. The resistor pair controls the speed of transfer of bias current from one transistor to another such that the current transfer will take the form of a hyperbolic tangent that will allow a very gentle start-up.

23 Claims, 2 Drawing Sheets

LOW EMI SHUTDOWN CIRCUIT FOR MODEM APPLICATIONS

BACKGROUND OF THE INVENTION

1. Field of the Invention

This invention relates generally to cable modem drivers, and more particularly to a low EMI shutdown driver circuit and method exhibiting very predictable and gentle cable modem start-up behavior.

2. Description of the Prior Art

Currently available technology relating to the present invention includes a Multimedia Cable Networking Standards (MCNS) compliant "external RF switch" architecture. By way of background, the Institute of Electronic and Electrical Engineering's (IEEE) 802.14 Cable TV Media Access Control and Physical Protocol Working Group was formed in 1994 to develop international standards for data communications over cable. The goal was to submit a cable modem Media Access Control and Physical Protocol standard to the IEEE in December 1995, but the delivery date slipped to late 1997.

Because of the delay in finalizing the IEEE 802.14 standard, certain cable operators, operating under a limited partnership, dubbed Multimedia Cable Network System Partners Ltd. (MCNS), proceeded to research and publish their own set of interface specifications for high-speed cable data services. MCNS released its Data Over Cable System Interface Specification (DOCSIS) for cable modem products to vendors in March 1997. Many vendors have announced plans to build products based on the MCNS DOCSIS standard.

There is a stringent requirement in the cable modem standard, DOCSIS, for cable modem drivers to transition between the power-up and power-down modes while keeping the disturbance on the line within a very tight limit. Existing solutions suppress the line glitch by using an external RF switch.

In view of the foregoing, a need exists for a bias current generator that exhibits very predictable and gentle start-up behavior and that mitigates the need for an external RF switch such as used with known solutions for suppressing line glitches.

SUMMARY OF THE INVENTION

To meet the above and other objectives, the present invention provides a bias current generator that exhibits very predictable and gentle start-up behavior. According to one embodiment, a TANH bias current generator has a 'distributed' output stage comprising a differential pair Q1/Q2 in combination with a pair of resistors R1 and R2 that act as a potentiometer controlling the amount of voltage seen across the input of the differential pair. The distributed output stage has a 'steering' input that controls the amount of bias current flowing through each transistor (Q1 and Q2). For a given bandgap voltage, ramp voltage and slope, resistors R1 and R2 control the speed of transfer of bias current from transistor Q1 to transistor Q2. For a linear voltage ramp, the voltage across base resistor R1 will be approximately linear, and therefore the current transfer from Q1 to Q2 will take the form of a hyperbolic tangent that will allow a very gentle start-up.

According to another embodiment, a third transistor Q1' is added to provide a non-zero "power-down" current. This embodiment is used when the bias current is required to be moved between two non-zero amounts. Transistor Q1 has an emitter area "A" and transistor Q1' has an emitter area "B". The ratio of "power-up" to "power-down" current is set by emitter area and is equal to B/A.

In one aspect of the invention, a bias current generator is implemented that exhibits very predictable and gentle start-up behavior.

In another aspect of the invention, a bias current generator is implemented that accommodates moving a bias current between two non-zero amounts.

In yet another aspect of the invention, a bias current generator is implemented that has low EMI during enable and disable modes of operation.

In still another aspect of the invention, a bias current generator is implemented for use in cable modem drivers that are required to meet DOCSIS for cable modem products.

In still another aspect of the invention, a bias current generator is implemented for use with any circuits that are required to transition between low-power and high-power modes in a manner consistent with low EMI.

BRIEF DESCRIPTION OF THE DRAWINGS

Other aspects and features of the present invention and many of the attendant advantages of the present invention will be readily appreciated as the same become better understood by reference to the following detailed description when considered in connection with the accompanying drawings in which like reference numerals designate like parts throughout the figures thereof and wherein.

While the above-identified drawing figures set forth particular embodiments, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENTS

Figure 1:
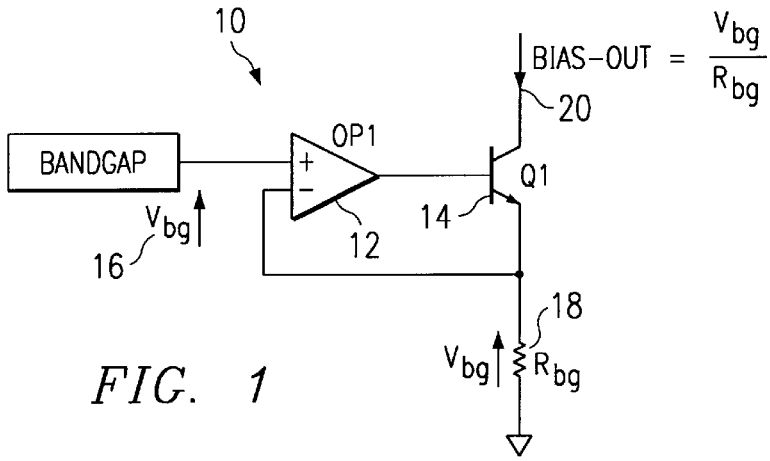
FIG. 1 is a schematic diagram illustrating a standard bias current generator that is known in the art.

As stated herein before, there is a stringent requirement in the cable modem standard, DOCSIS, for cable modem drivers to transition between the power-up and power-down modes while keeping the line disturbance within a very tight limit. Existing solutions suppress the line glitch by using an external RF switch. Looking now at FIG. 1, a schematic diagram illustrates a standard bias current generator 10 that is known in the art. Amplifier Op1 (12) and transistor Q1 (14) operate to buffer bandgap voltage Vbg (16). The bandgap voltage 16 can therefore be made to appear across Rbg (18). This causes a current Vbg/Rbg (20) to flow into the emitter of Q1 (14) and out through its collector where it appears as the output bias current.

Figure 2:
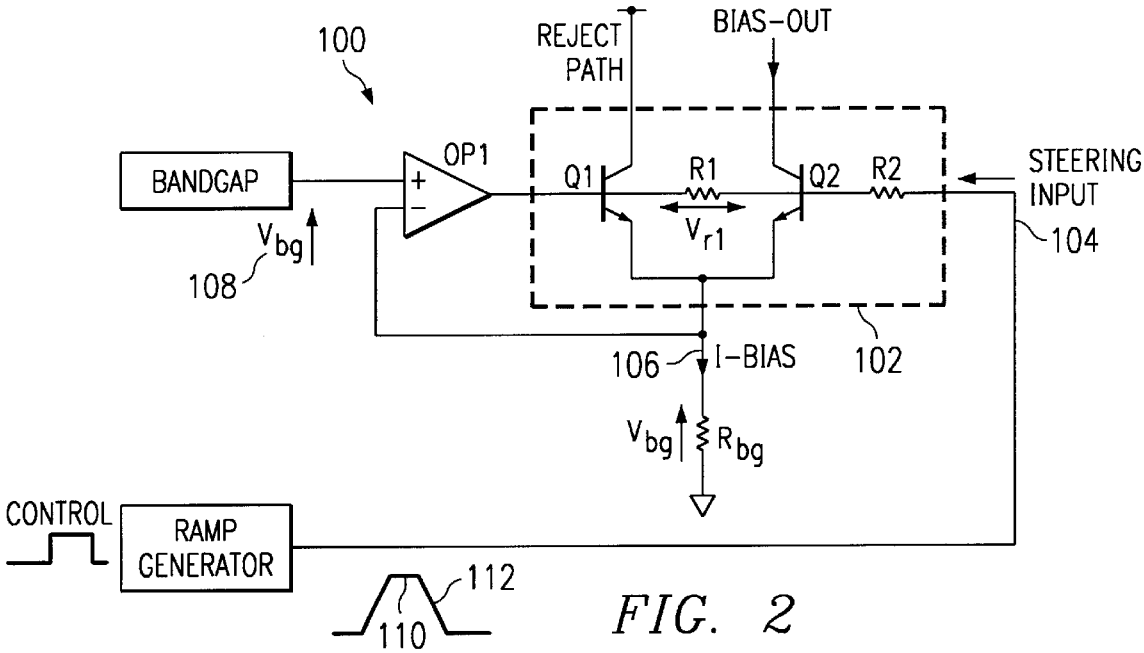
FIG. 2 is a schematic diagram illustrating a TANH bias current generator according to one embodiment of the present invention.
Figure 3:
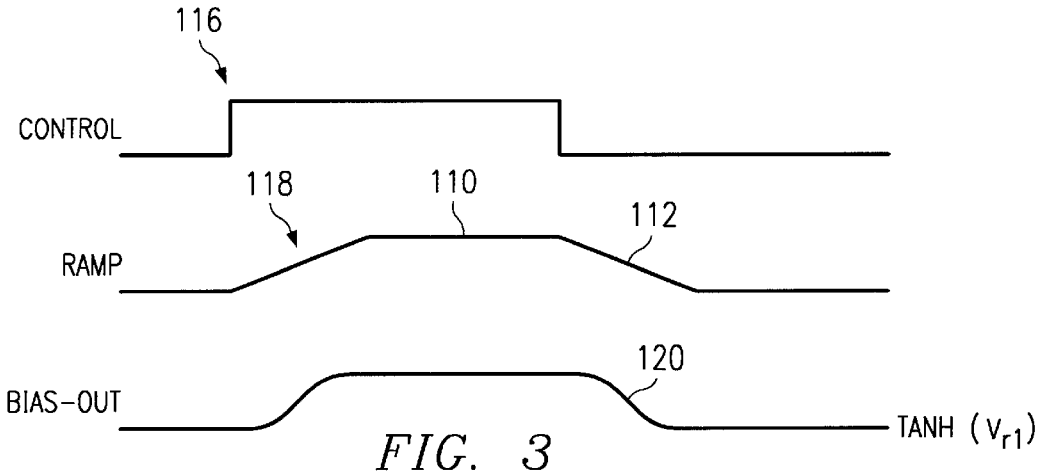
FIG. 3 is a diagram illustrating control, ramp and bias-out waveforms for the TANH bias current generator shown in FIG. 2.

FIG. 2 is a schematic diagram illustrating a TANH bias current generator 100 according to one embodiment of the present invention. The TANH bias current generator 100 modifies the standard bias current generator 10 by using a 'distributed' output stage 102 comprising transistor Q1, transistor Q2, resistor R1 and resistor R2. The distributed output stage 102 has a 'steering' input 104 that controls the amount of the bias current (I-Bias=Vbg/Rbg) 106 flowing through each of Q1 and Q2. Resistors R1 and R2 act as a potentiometer controlling the amount of voltage seen across the input of the differential pair Q1/Q2. For a given bandgap voltage 108, ramp voltage 110 and slope 112 therefore, R1/R2 will control the speed of transfer of bias current 106 from Q1 to Q2. For a linear voltage ramp (slope) 112, the voltage across R1 will be approximately linear; and thus the current transfer from Q1 to Q2 (Bias-Out 120) will take the form of a hyperbolic tangent such as seen in FIG. 3. FIG. 3 illustrates control 116, ramp 118 and bias-out 120 waveforms for the TANH bias current generator 100 shown in FIG. 2.

Figure 4:
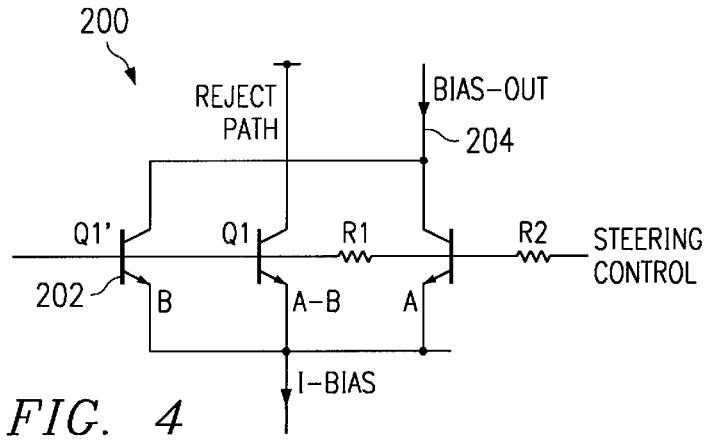
FIG. 4 is a schematic diagram illustrating the TANH bias current generator shown in FIG. 2 modified to provide a non-zero "power-down" current.

FIG. 4 is a schematic diagram illustrating another TANH bias current generator 200 modified to provide a non-zero "power-down" current. This bias current generator 200 can be used when the bias current is required to be moved between two non-zero amounts. It is used in the same manner as the TANH bias current generator 100 depicted in FIG. 2, but Q1' (202) is included to provide a non-zero "power-down" current. The ratio of "power-up" to "power-down" current is set by emitter area and is equal to B/A for the bias current generator 200 illustrated in FIG. 4. The Bias-Out current 204 is therefore B/A*I-Bias or simply I-Bias (ignoring $h_{fe}$ effects).

Figure 5:
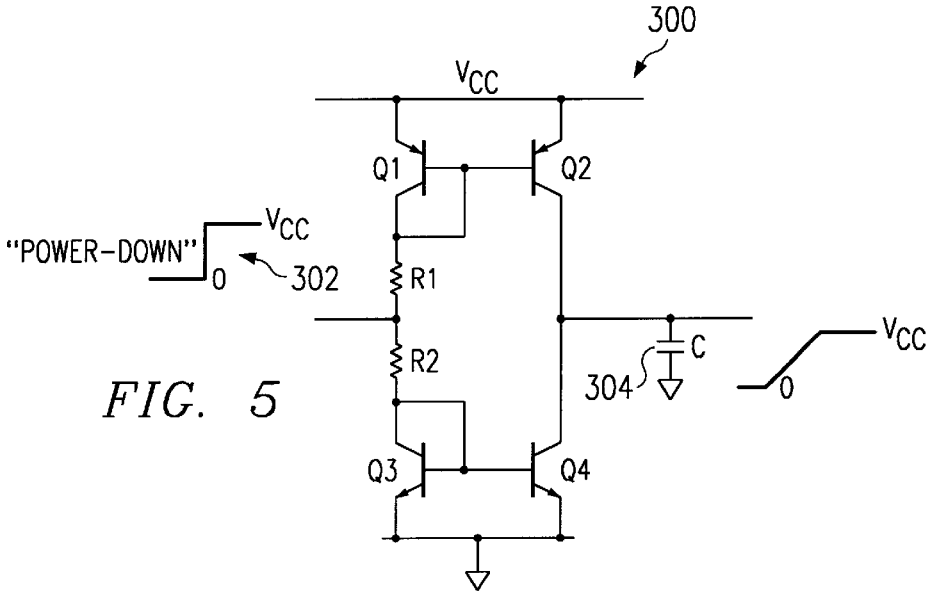
FIG. 5 is a schematic diagram illustrating a ramp generator suitable for use with the TANH bias current generators depicted in FIGS. 2 and 4.

FIG. 5 is a schematic diagram illustrating a ramp generator 300 suitable for use with the TANH bias current generators 100, 200 depicted in FIGS. 2 and 4 respectively. The "power-down" signal 302 can be seen to be a logic signal that switches between Vcc and ground (0) voltage levels. Capacitor 304 is therefore charged by a current $(Vcc-V_{beQ1})/R1$ and discharged by a current $(Vcc-V_{beQ3}/R2$. Simplifying, $V_{beQ1}=V_{beQ3}=V_{be}$, and R1=R2=R; then $$dv/dt=(Vcc-V_{be})/RC. \quad (1)$$

The present inventors found that when this ramp generator 300 is used as the ramp generator for the bias current generators 100, 200 illustrated in FIGS. 2 and 4 respectively, the impedance of capacitor 304 at the switching frequency must be kept considerably lower than R2 for the voltage across R1 to be maintained as a linear ramp.

The bias current generators 100, 200 were found to exhibit low EMI during the enable and disable modes of operation. This feature is necessary to implement cable modem drivers or any other circuits that are required to generate low EMI when transitioning between low-power and high-power modes, such as cable modem drivers that are required to meet DOCSIS for cable modem products.

In view of the above, it can be seen the present invention presents a significant advancement in the art of cable modem driver technology. Further, this invention has been described in considerable detail in order to provide those skilled in the data communication art with the information needed to apply the novel principles and to construct and use such specialized components as are required. In view of the foregoing descriptions, it should further be apparent that the present invention represents a significant departure from the prior art in construction and operation. However, while particular embodiments of the present invention have been described herein in detail, it is to be understood that various alterations, modifications and substitutions can be made therein without departing in any way from the spirit and scope of the present invention, as defined in the claims which follow. For example, although various embodiments have been presented herein with reference to particular functional architectures and characteristics, the present inventive structures and characteristics are not necessarily limited to particular circuit architectures or sets of characteristics as used herein. It shall be understood the embodiments described herein above can easily be implemented using many diverse signal processing elements so long as the combinations achieve a bias current generator according to the inventive principles set forth herein above.

What is claimed is:

1. A bias current generator comprising:

a differential amplifier pair including first and second transistors, each transistor having a base, emitter and collector;

a ramp generator;

a bandgap voltage generator;

a first resistor connected at one end to the first transistor base and connected at its opposite end to the second transistor base;

a second resistor connected to the first and second transistor emitters and connected at its opposite end to a common ground;

a third resistor connected at one end to the second transistor base and connected at its opposite end to the ramp generator; and a buffer having a positive signal input configured to receive a bandgap voltage generated by the bandgap voltage generator and a negative signal input configured to receive a feedback signal generated at the first and second transistor emitters and an output connected to the first transistor base, wherein the buffer generates an output signal at its output in response to the bandgap voltage and the feedback signal.

2. The bias current generator according to claim 1 wherein the ramp generator is configured to generate a trapezoidal waveform signal in response to a logic input signal.

3. The bias current generator according to claim 2 wherein the first and second resistors are configured to control a bias current transfer speed associated with transferring bias current from the first transistor to the second transistor such that the bias current transfer can be accomplished as a hyperbolic tangent function.

4. The bias current generator according to claim 1 further comprising a third transistor having a base connected to the base of the first transistor, a collector connected to the collector of the second transistor and an emitter connected to the first and second transistor emitters such that the third transistor can provide a non-zero power-down current for the bias current generator.

5. The bias current generator according to claim 4 wherein the second and third transistors have emitter areas configured to establish a ratio of power-up current to power-down current for the bias current generator.

6. A cable modem bias current generator comprising:

a distributed output stage comprising:

a differential amplifier pair having a first input and further having a steering input operational in response to a ramp voltage to control bias current flowing through each transistor within the differential amplifier pair; and means for controlling bias current transfer speed between the differential amplifier pair transistors.

7. The bias current generator according to claim 6 wherein the means for controlling bias current transfer speed comprises a pair of resistors configured as a potentiometer and operational to control a voltage appearing across the first input and the steering input.

8. The bias current generator according to claim 7 further comprising a ramp generator operational to generate and communicate a trapezoidal voltage waveform to the steering input.

9. The bias current generator according to claim 8 further comprising means for generating and communicating a bandgap voltage to the first input.

10. The bias current generator according to claim 9 wherein the means for generating and communicating a bandgap voltage to the first input comprises:

a bandgap voltage generator; and a buffer configured to receive a bandgap voltage generated by the bandgap voltage generator and a feedback voltage generated by the distributed output stage and thereby generate and communicate the bandgap voltage to the first input.

11. The bias current generator according to claim 6 wherein the distributed output stage further comprises a power-down transistor operational to provide a non-zero power-down current for the bias current generator in response to a power-down signal presented to the steering input.

12. A cable modem bias current generator comprising:

means for generating a buffered bandgap voltage;

means for generating a steering voltage; and means for generating an output bias current in response to the buffered bandgap voltage and the steering voltage such that the output bias current can change as a hyperbolic tangent function.

13. The cable modem bias current generator according to claim 12 wherein the means for generating a buffered bandgap voltage comprises a non-inverting amplifier.

14. The cable modem bias current generator according to claim 12 wherein the means for generating a steering voltage comprises a ramp generator.

15. The cable modem bias current generator according to claim 12 wherein the means for generating an output bias current comprises a distributed output stage.

16. The cable modem bias current generator according to claim 15 wherein the distributed output stage comprises a differential amplifier transistor pair.

17. The cable modem bias current generator according to claim 16 wherein the distributed output stage further comprises a resistor pair configured as a potentiometer to control an input voltage presented to the differential amplifier transistor pair.

18. The cable modem bias current generator according to claim 16 wherein the distributed output stage further comprises a resistor pair configured to control a rate of bias current transfer between the differential amplifier transistors.

19. A cable modem bias current generator according to claim 18 wherein the rate of bias current transfer is in the form of a hyperbolic tangent function.

20. The cable modem bias current generator according to claim 12 further comprising means for providing a non-zero power-down bias current.

21. The cable modem bias current generator according to claim 20 wherein the means for providing a non-zero power-down bias current comprises a transistor having a first emitter area, wherein a ratio of the first emitter area to an emitter area associated with a predetermined differential amplifier transistor is capable of setting a desired level for the non-zero power-down bias current.

22. A method of generating a bias current for a cable modem comprising the steps of:

a) generating a bandgap voltage;

b) generating a ramp voltage having a predetermined slope; and c) generating a bias current having a power-up waveform and a power-down waveform that vary as a hyperbolic tangent function in response to the bandgap voltage, ramp voltage and ramp voltage slope.

23. The method according to claim 22 wherein the step of generating a bias current comprises the step of controlling a transfer speed of bias current between differential amplifier pair transistors such that the transfer speed of current varies as a hyperbolic tangent function.

* * * * *